United States Patent [19]

Yonkers

[11] 4,333,203

[45] Jun. 8, 1982

[54] CONVERSION ATTACHMENT FOR A WET-DRY VACUUM CLEANER

[75] Inventor: Robert A. Yonkers, Grandville, Mich.

[73] Assignee: Bissell, Inc., Grand Rapids, Mich.

[21] Appl. No.: 139,106

[22] Filed: Apr. 23, 1980

[51] Int. Cl.[3] ..... A47L 7/00; A47L 11/34

[52] U.S. Cl. ..... 15/321; 15/322; 15/339

[58] Field of Search ..... 15/320, 321, 322, 339

[56] References Cited

U.S. PATENT DOCUMENTS

| | | | |
|---|---|---|---|
| 2,270,579 | 1/1942 | Chamberlin et al. | 15/322 X |
| 2,849,080 | 8/1958 | Enright | 15/339 X |
| 3,599,272 | 8/1971 | Merrick | 15/321 |
| 3,939,527 | 2/1976 | Jones | 15/321 X |
| 4,123,818 | 11/1978 | Hurwitz | 15/339 X |
| 4,127,913 | 12/1978 | Monson | 15/321 |
| 4,218,900 | 8/1980 | Caplan et al. | 15/322 X |
| 4,226,000 | 10/1980 | Tribolet | 15/321 |

*Primary Examiner*—Chris K. Moore

*Attorney, Agent, or Firm*—Andrus, Sceales, Starke & Sawall

[57] ABSTRACT

A conversion attachment for a wet-dry vacuum cleaner provides for the application of a mixture of water and detergent through a spray assembly mounted adjacent to a vacuum nozzle on a cleaning head. The attachment includes a spray nozzle and associated liquid flow lines for connection to a source of water, a detergent container, and a siphon for injecting detergent into the pressurized flowing water. The attachment may also include a substitute wand and cleaning head. The siphon includes a slideable valve member which, in one position, permits mixing of the detergent and water for supply to the spray nozzle. In another position, the valve member blocks flow of all liquid to the spray nozzle.

18 Claims, 6 Drawing Figures

CONVERSION ATTACHMENT FOR A WET-DRY VACUUM CLEANER

U.S. PRIOR ART OF INTEREST

Patent Nos.

| | | |
|---|---|---|
| 2,381,589 | Hayes | Aug. 7, 1945 |
| 2,388,445 | Stewart | Nov. 6, 1945 |
| 2,571,870 | Hayes | Oct. 16, 1951 |
| 2,571,871 | Hayes | Oct. 16, 1951 |
| 3,029,461 | Osborn | Apr. 17, 1962 |
| 3,079,626 | Yonkers et al | Mar. 5, 1963 |
| 3,939,527 | Jones | Feb. 24, 1976 |
| 3,940,826 | Phillips et al | Mar. 2, 1976 |
| 4,127,913 | Monson | Dec. 5, 1978 |

BACKGROUND AND SUMMARY OF THE INVENTION

This invention relates to a conversion attachment for a wet-dry vacuum cleaner.

It is already known to provide a so-called wet-dry vacuum cleaner for floors and fabrics, such as carpets and upholstery. Such vacuum cleaners include a large portable recovery tank having a vacuum pump and a vacuum head connected via a wand and hose to the tank for sucking wet and/or dry material from the surface being cleaned into the tank. Such devices also may be provided with a spray nozzle in the cleaning head for dispensing pressurized water from a faucet or the like onto the surface to be cleaned. U.S. Pat. No. 4,127,913 shows such a cleaning device and additionally discloses that the air discharge outlet of the tank may be connected through a hose to a separate detergent dispenser which may be used to apply detergent to the surface to be cleaned prior to the water dispensing and vacuuming operation.

It is desirable to dispense both detergent and water onto the surface simultaneously to thereby reduce the total cleaning time. The device of the said U.S. Patent could be used in this manner, but it would require the manipulation of both the vacuum head and the separate detergent dispenser at the same time, a rather cumbersome and almost impossible procedure for one person. Additionally, if both devices were operated simultaneously in the said U.S. Pat. No. 4,127,913, an undesirable vacuum pressure drop would occur.

Devices are already known which are specifically made to dispense water and detergent together, such as U.S. Pat. No. 3,939,527. However, to have the advantages of such devices as well as those of a wet-dry vacuum cleaner would require the purchase of both types of machines, which would be uneconomical.

Furthermore, it is also known, as in the aforementioned Pat. No. 3,939,527, to use a siphoning device to dispense detergent into a flowing stream of water for mixing therewith and application to the surface to be cleaned. However, many such siphoning devices are relatively complex and expensive and rely for their operation on spring biased ball valves and the like.

It is a task of the present invention to provide a wet-dry vacuum cleaner that has the capability of automatically dispensing a mixture of liquid detergent and water simultaneously with the vacuum pick-up for faster and more efficient cleaning of floors and fabrics.

It is a further task of the invention to provide a conversion attachment or kit which is easily connectable to the presently known wet-dry vacuum cleaners.

It is yet another task of the invention to provide one form of conversion attachment wherein a substitute cleaning head is provided which not only provides the usual vacuum pickup function of a wet-dry vacuum cleaner, but which also provides for dispensing a continuous stream of mixed water and detergent onto the area to be cleaned.

It is still another task of the invention to provide another form of conversion attachment wherein the existing vacuum pickup cleaning head of a wet-dry vacuum is utilized instead of a substitute.

It is a further task of the invention to provide a liquid flow control device as part of either form of the conversion attachment for use in selectively supplying liquid for cleaning, the device being of an improved simplified design.

In accordance with one aspect of the invention, in one form of attachment both the original wand and cleaning head of the wet-dry vacuum cleaner are replaced with a substitute wand and head. A supply and connector assembly is provided which includes a short tubular connecting member. One end of the member is connectable to the upper end of the substitute wand which leads to the substitute cleaning head which includes a vacuum nozzle and a liquid discharge means such as a spray nozzle. The other end of the member is connectable to the hose of the wet-dry vacuum unit. The connecting member forms a part of the suction line of the wet-dry vacuum cleaner and provides for the support of the assembly.

In accordance with another aspect of the invention, in another form of attachment, the existing wand and cleaning head are not replaced so that the original suction line is unchanged. In this instance, the liquid discharge means is removably attached to the existing cleaning head and the supply and connector assembly is removably attached to the suction line.

In accordance with another aspect of the invention, the supply and connector assembly mounts a removable detergent container and a siphon which is connectable between a source of water, such as a water faucet, and the liquid discharge means of the cleaning head. A detergent supply tube connects between the container and the siphon. The siphon is part of a control comprising a single slideable tubular valve member controlled by a manually actuatable trigger or handle. The slideable tubular member is disposed in an elongated housing or valve body having spaced side inlet ports connectable to the faucet and the detergent container, respectively, and having an outlet passage connected to the liquid discharge means of the cleaning head. The side wall of the slideable tubular member has an opening and its inner end has a restricted passage forming a throat.

When the slideable tubular member is retracted to place its interior in communication with the pressurized water supply, its throat is disposed adjacent the inlet port from the detergent container and in spaced relation from the outlet passage of the valve body to form a metering chamber. Pressurized water flows from the faucet through the restricted throat and the metering chamber and then through the outlet passage. Detergent is siphoned from the container into the metering chamber where it mixes with the flowing water.

An aspect of the invention contemplates that when the slideable tubular valve member is extended, both inlets from the faucet and detergent are blocked and the metering chamber is eliminated so that flow of all liquid to the cleaning head is blocked.

BRIEF DESCRIPTION OF THE DRAWINGS

The accompanying drawings illustrate the best mode presently contemplated by the inventor for carrying out the invention.

In the drawings.

DESCRIPTION OF THE PREFERRED EMBODIMENTS

Figure 1:
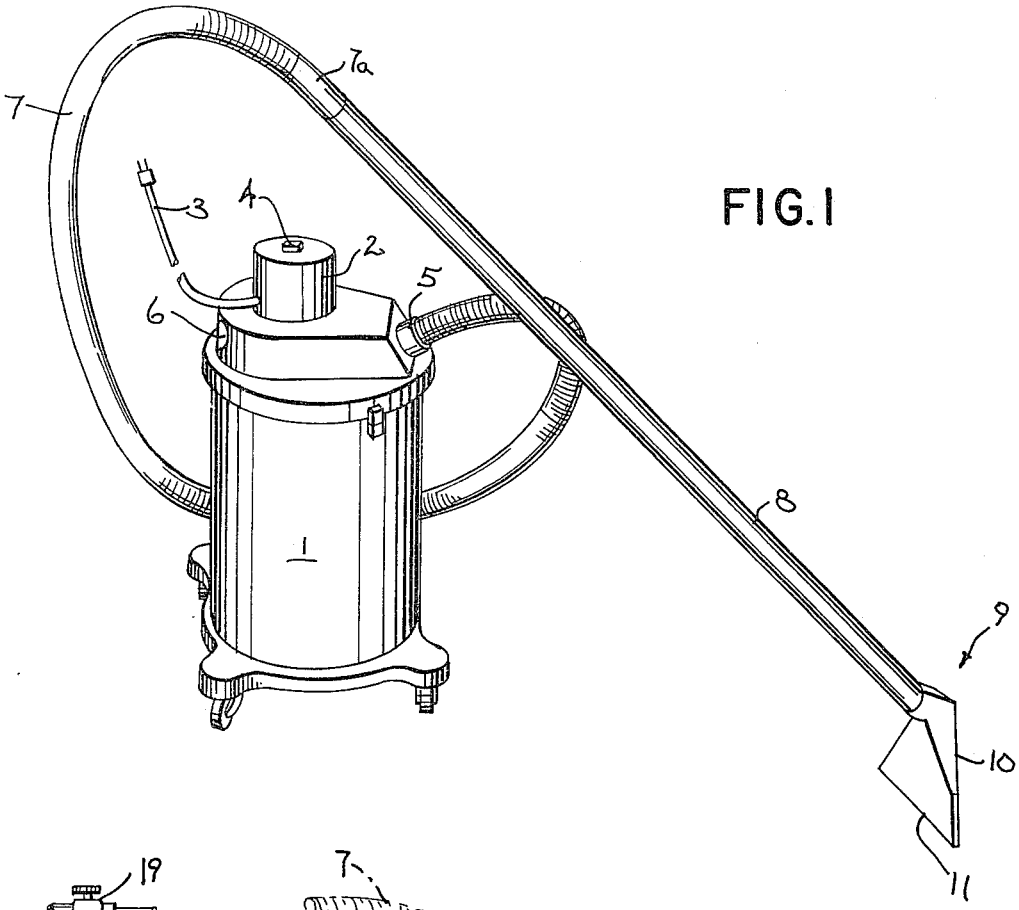
FIG. 1 is a perspective view of a wet-dry vacuum cleaner in its original state and to which the conversion attachment of the invention may be applied.

FIG. 1 of the drawings shows a well known type of wet-dry vacuum cleaner. Generally, the basic cleaner has a portable tank 1 for storage of recovered dry or wet materials. A vacuum pump 2 is mounted to tank 1, is connectable to a suitable source of electric power, as through a line cord 3, and has a suitable on-off switch 4. Tank 1 has a vacuum inlet 5 and an air discharge outlet 6. Vacuum inlet 5 is connected through flexible hose 7 having a rigid tubular handle fitting *7a* to a cleaning unit comprising a rigid tubular wand 8 and a cleaning head 9 attached to the lower wand end. As shown, head 9 includes a vacuum nozzle 10 having an inlet 11 for engaging the surface to be cleaned, and which communicates through the suction line formed by wand 8 and hose 7 to tank 1.

The conversion kit or attachment of the invention is intended to easily convert the wet-dry vacuum cleaner of FIG. 1 from a vacuum-only device into a device which additionally dispenses a mixture of detergent and water. For this purpose, and in the form of attachment shown in FIG. 2, a substitute cleaning unit is provided and adapted to be attached to fitting *7a*, in a manner to be described. The substitute cleaning unit includes a substitute wand 12 having a substitute cleaning head 13 mounted to the lower end thereof and includes a vacuum nozzle 14 having an inlet 15, and additionally includes a liquid discharge means such as a spray nozzle 16 mounted thereon. A pressure line 18 is connected to nozzle 16 and is carried by wand 12. The kit includes a supply and connector assembly 20 which, in this version is adapted to be inserted in both the suction and water lines.

Assembly 20 includes a generally unitary base member 21 of plastic or other suitable material which is formed to support the multiple functions of water flow, detergent storage and dispensing, and vacuum removal.

For this purpose, member 21 includes a short tubular portion 22 forming an air and liquid flow chamber 23. One end 24 of tubular portion 22 is adapted to be telescopingly fitted within the upper end of wand 12 and held in position by any suitable means such as the well known latching device 25.

The other end of tubular portion 22 is adapted to be telescoped over the outer end of handle *7a*, with the members suitably locked together, as by a latching device 26.

For purposes of controlling liquid flow, base member 21 is formed with a transverse flange 27 which extends outwardly from tubular portion 22 and which fixedly mounts a tubular valve body 28 having a pair of inlet ports 29 and 30 which in the present embodiment are longitudinally spaced and in the same plane. Valve body 28 is shown as extending parallel to tubular portion 22, with one end thereof merging into a radially inwardly tapered portion 31, having a venturi opening 32. Opening 32 is connected to a liquid discharge or outlet port 33. When installing assembly 20, pressure hose 18 is severed, with the ends being telescopingly attached to inlet port 29 and outlet port 33 to divide hose 18 into inlet and outlet line portions. The inlet line portion of hose 18 is connectable to a source of water under pressure such as a faucet 19.

In accordance with one aspect of the invention, it is desired to inject cleaning detergent into the pressurized water flowing from the faucet before it reaches spray nozzle 16. For this purpose, flange 27 also forms a threaded supporting cover 34 for a detergent container 35. Cover 34 is provided with a suitable pressure relief mechanism 36. A tube 37 extends from within container 35 for connection telescopingly into inlet port 30 of valve body 28. Tube 37 extends through cover 34 and may be divided into two lengths by a restrictive choke 38 in the cover.

Figure 3:
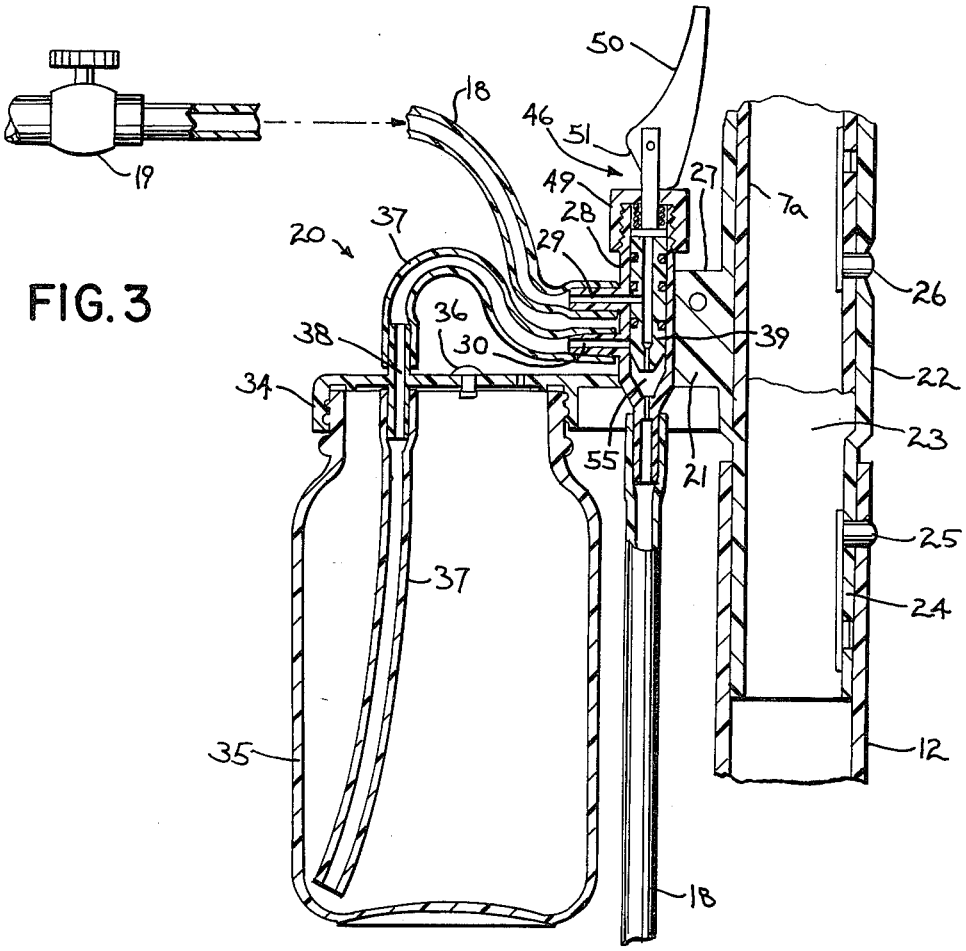
FIG. 3 is an enlarged sectional view of the supply and connector assembly of the conversion attachment of FIG. 2.
Figure 4:
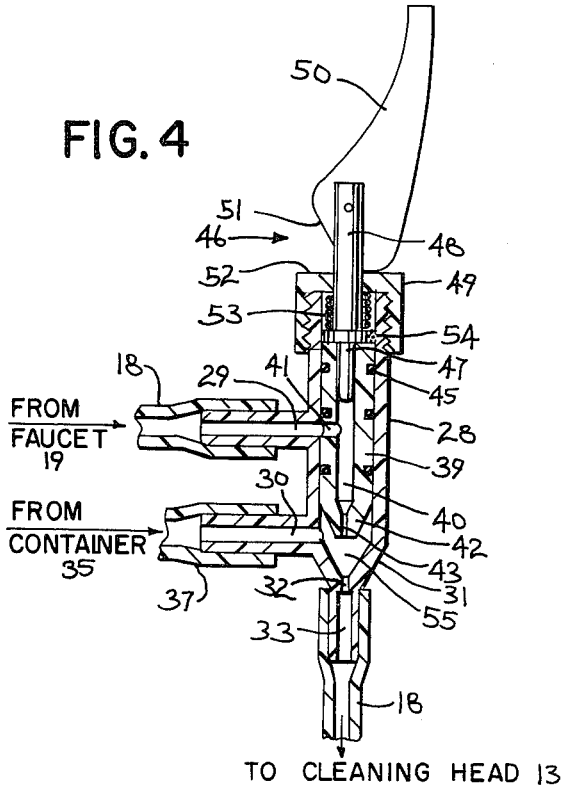
FIG. 4 is an enlarged fragmentary longitudinal section of the assembly of FIG. 3 showing the valve member retracted.

Fluid flow and detergent injection is controlled by a unique simplified structure. For this purpose, and as best seen in FIGS. 3 and 4, a tubular valve member 39 is slideably disposed in valve body 28 and has an axial longitudinal passage 40 therein. An inlet opening 41 is disposed in the side wall of member 39, about midway of its length, and is generally co-planar with inlet ports 29 and 30. The inner portion of member 39 tapers radially inwardly to form a head end 42, with an axial discharge passageway forming a restrictive throat 43 therein. Throat 43 is co-axial with and faces outlet port 33.

A plurality of O-rings 45 in valve member 39 provide a seal between its longitudinal outer wall and the inner wall of valve body 28.

Means are provided to shift valve member 39 between a retracted position permitting fluid flow to nozzle 16, and an extended position wherein all flow is blocked. For this purpose, a control rod 46 is secured to the outer end portion of member 39. Rod 46 has an inner portion 47 disposed within passage 40 of member 39, and an outer portion 48 which extends outwardly through a cap 49 which is adjustably threaded to the outer end of valve body 28. A trigger-like handle 50 having a cam surface 51 is pivotally mounted to outer end portion 48 of rod 46.

Means are provided to bias valve member 39 toward outlet port 33 and to simultaneously bias cam 51 against the top portion 52 of cap 49. For this purpose, a spring 53 is disposed within valve body 28 and is confined between cap 49 and an annular flange 54 which is formed on rod 46 and engages the outer end of valve member 39.

When handle 50 is in its raised actuating position, as shown in FIGS. 3 and 4, valve member 39, which is shorter than valve body 28, is retracted longitudinally outwardly against spring 53 so that it terminates away from outlet port 33 to thereby form a metering chamber 55 adjacent tapered portion 31 which communicates with ports 30 and 33 as well as throat 43. Water inlet port 29 connects through opening 41 and throat 43 to the metering chamber 55 and outlet port 33, and hence through hose 18 to cleaning head 13. When the faucet is turned on, water under pressure will flow through the system to spray nozzle 16. At the same time, the vacuum or siphoning effect of water passing through throat 43 and metering chamber 55 causes detergent to be drawn from container 35 through tube 37, and hence injected from port 30 into the water.

Figure 5:
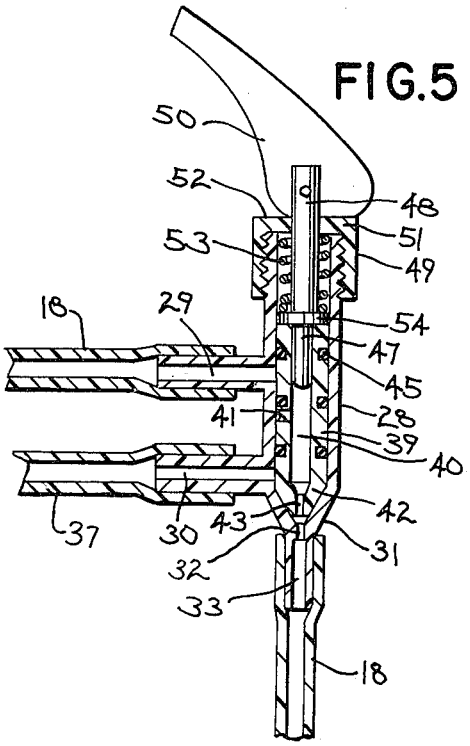
FIG. 5 is a view similar to FIG. 4 showing the valve member extended.

When hand pressure is removed from handle 50, spring 53 causes handle 50 to move to its lowered position, as shown in FIG. 5. Valve member 39 shifts to its extended position so that its tapered head end 42 substantially fills and eliminates the former metering chamber 55, with throat 43 in close proximity to venturi opening 32. Tapered portion 42 is shown as in approximate seated engagement and nesting within tapered portion 31 of the valve body 28. Opening 41 no longer registers with water inlet port 29, and both the latter port and detergent inlet port 30 are blocked by the wall of valve member 39. Under these conditions, no liquid can flow through assembly 20 to head 13, even if the faucet is turned on.

Figure 2:
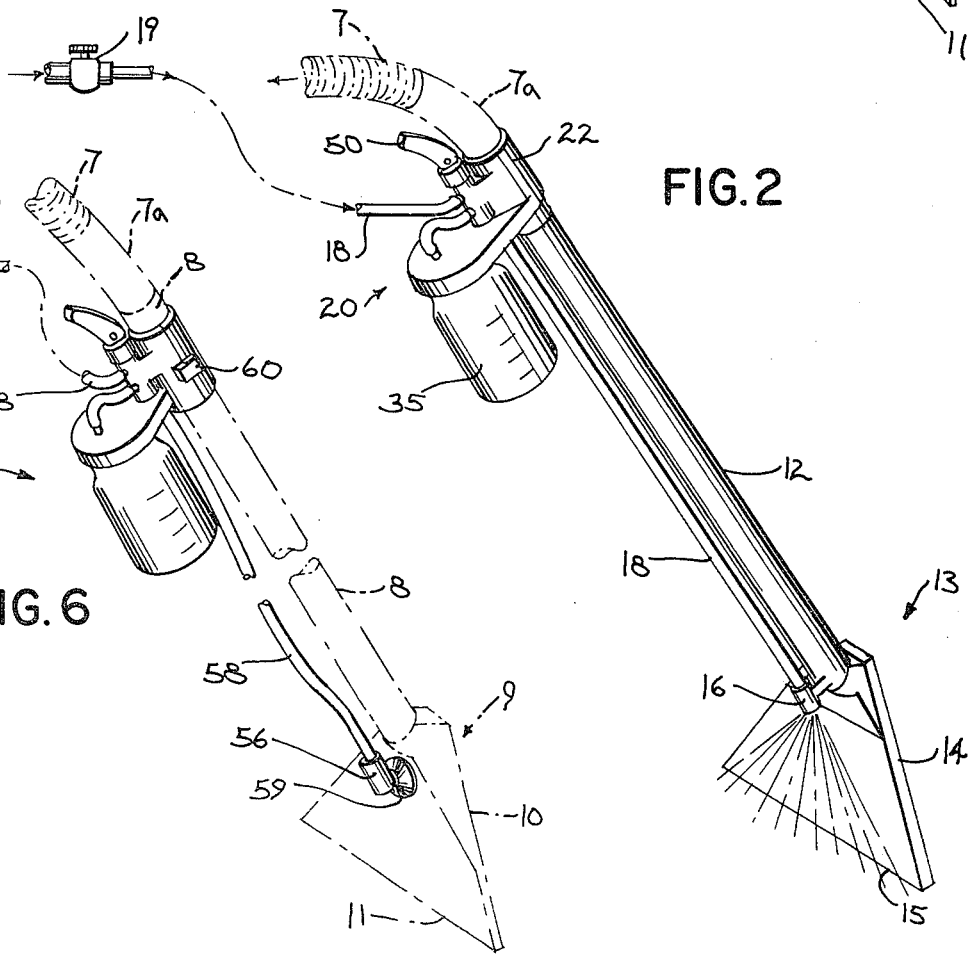
FIG. 2 is a fragmentary view of a portion of the cleaner of FIG. 1, and showing one form of the attachment mounted to the cleaner, with certain parts substituted for the originals.

Briefly, when the conversion kit has been applied to the wet-dry vacuum device of FIG. 1, as shown in FIG. 2, faucet 19 is opened and switch 4 turned to its "on" position to activate the vacuum at cleaning head 13. Handle 50 is raised by squeezing it toward the handle portion *7a* so that a combination of pressurized water and metered detergent is continuously fed to spray nozzle 16 of head 13. The head may then be movably translated over the surface to be cleaned. The dirty liquid is sucked up through inlet 15 and hence passes back through tubular portion 22 of assembly 20 to the cleaner, where it is deposited in recovery tank 1.

If it is desired to stop the liquid spray, either with or without turning off the vacuum, handle 50 may be released to block the liquid flow. If it is desired to stop the vacuum while continuing with liquid application, all that need be done is to turn switch 4 off.

Figure 6:
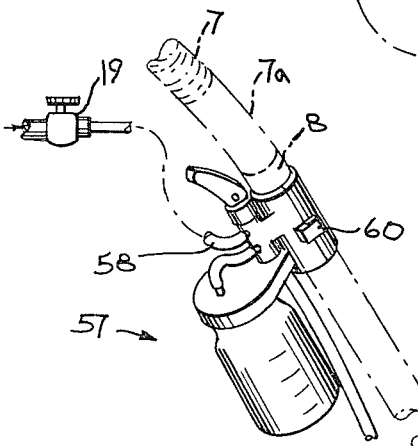
FIG. 6 is a fragmentary view of a portion of the cleaner of FIG. 1, and showing another form of attachment mounted to the existing parts of the cleaner.

The second form of conversion attachment, shown in FIG. 6, utilizes the same basic principles of the heretofore described attachment. However, in this instance, the original cleaning unit including wand 8 and cleaning head 9 is used. The portions shown in phantom lines comprise the parts of the original wet-dry cleaner of FIG. 1, while the portions comprising the conversion attachment are shown in full lines.

As shown, this form of kit comprises a liquid discharge means such as a spray nozzle 56, a supply and connector assembly 57 and a liquid conduit or line 58, all corresponding generally to the previously described respective elements 16, 20 and 18.

Suitable means are provided on the conversion attachment to removably secure nozzle 56 to existing head 9. The means shown in Fig. 6 comprises a suction cup 59 attached to nozzle 56 and adapted for securement to the head in the usual manner.

Suitable means are also provided on the attachment to removably secure supply and connector assembly 57 to the suction line. The assembly could be connected between hose 7 and wand 8 in a manner similar to that shown in FIGS. 2 and 3. However, in the present embodiment, the assembly does not utilize a flow chamber such as 23 in FIG. 3, and is instead merely secured to the side of wand 8 by a removable adjustable clamp 60. The assembly could possibly be clamped to the side of hose 7 without departing from the spirit of the invention.

Liquid line 58 is divided into two parts, as in the prior form of attachment, by assembly 57. Line 58 is connected at one end to nozzle 56 and is adapted for connection to a source of pressurized water, such as faucet 19.

This second form of conversion kit provides essentially similar functions and advantages as the first form. That is, it gives a conventional wet-dry vacuum unit the capability of shampooing floors, fabrics and the like.

The concepts of the invention provide a unique way of converting a wet-dry vacuum cleaner into a device for dispensing a mixture of water and detergent, while continuing to vacuum up the material on the surface to be cleaned.

Various modes of carrying out the invention are contemplated as being within the scope of the following claims particularly pointing out and distinctly claiming the subject matter which is regarded as the invention.

I claim:

1. For use with a source of water under pressure and a wet-dry vacuum cleaner having a recovery tank with an inlet and an outlet and means for selectively vacuumizing said tank, said cleaner further having a vacuum conduit connected to said inlet and a wand connected to said conduit, said wand having a cleaning head at its lower end with said head including a vacuum nozzle connected through said wand and conduit to said inlet; a conversion attachment for said vacuum cleaner and comprising:

(a) a substitute wand connectable to said vacuum conduit to form a suction line therewith and with said wand having a substitute cleaning head with a vacuum nozzle, (b) liquid discharge means mounted on said substitute cleaning head, (c) a water line connected to said liquid discharge means and adapted for connection with said source of water, (d) an assembly inserted in said water line, said assembly including a detergent container and also including liquid flow control means for dispensing detergent into said water line when water is flowing therethrough from the water source, (e) means for mounting said assembly to said suction line, (f) means disposed on said liquid flow control means for connecting the latter into said water line to thereby divide the latter into inlet and outlet line portions, (g) a detergent line connected between the interior of said detergent container and said liquid flow control means, (h) said liquid flow control means being constructed to selectively dispense pressurized water and detergent through said outlet line portion to said liquid discharge means on said substitute cleaning head, said liquid flow control means comprising:

(1) a member forming a valve body having:

(A) a water inlet port connectable to said inlet line portion, (B) a detergent inlet port connected to said detergent line, (C) and a liquid outlet port connectable to said outlet line portion, (2) said ports being positioned so that said detergent inlet port is disposed between said water inlet port and said liquid outlet port, (3) a tubular valve member shorter than and slideably disposed in said valve body, said valve member having an inlet opening in its wall which is selectively registrable with said water inlet port, and having an inner head end having a discharge passageway disposed therein which faces said liquid outlet port, (4) said valve member being movable longitudinally in said valve body between:

(A) a retracted position wherein said inlet opening registers with said water inlet port and said head end terminates longitudinally outwardly of said liquid outlet port to form a metering chamber communicating with said detergent inlet port, said discharge passageway and said liquid outlet port, (B) and an extended position wherein the valve member wall blocks said water and detergent inlet ports and said metering chamber is replaced by the said head end of the valve member, (5) and means to move said valve member between said retracted and extended positions to thereby control the flow of liquid from said outlet port to said liquid discharge means of said substitute cleaning head, (i) the construction being such that, upon actuation of said liquid flow control means of said assembly and said tank vacuumizing means of said cleaner, a mixture of water and detergent liquid is discharged through said liquid discharge means onto the surface to be cleaned and subsequently removed to the said recovery tank of said cleaner.

2. The conversion attachment of claim 1:

(a) wherein said assembly includes a tubular portion forming a vacuum air and liquid flow chamber, (b) and wherein said assembly mounting means comprises means disposed on each end of said tubular portion for securing the latter between said vacuum conduit and said substitute wand for support of said assembly, (c) the construction being such that said subsequent liquid removal is through said tubular portion of said assembly.

3. The conversion attachment of claim 1 wherein the said discharge passageway of said valve member forms a restricted throat which cooperates with said detergent inlet port to form a siphon for detergent in said container.

4. The conversion attachment of claim 3 wherein:

(a) the said head end of said valve member and the portion of said valve body adjacent said liquid outlet port are tapered, (b) and the tapered portion of said valve member nests within the tapered portion of said valve body when said valve member is in its extended position.

5. The conversion attachment of claims 1, 3, or 4 wherein said valve member moving means comprises:

(a) a cap disposed on the outer end of said valve body, (b) a control rod connected to said valve body and extending outwardly through said cap, (c) a manually actuatable handle pivotally mounted to the outer end portion of said control rod, (d) and a cam on said handle and engageable with said cap for causing said control rod and said valve member to shift longitudinally when said handle is actuated.

6. The conversion attachment of claim 5 which includes means to bias said valve member longitudinally inwardly toward said liquid outlet port.

7. The conversion attachment of claim 6 wherein said biasing means simultaneously biases said cam into engagement with said cap.

8. The conversion attachment of claim 7 wherein:

(a) said control rod includes annular flange means disposed between the outer end of said valve member and said cap, (b) and said biasing means comprises a spring confined between said flange means and said cap.

9. For use with a source of water under pressure and a wet-dry vacuum cleaner having a recovery tank with an inlet and an outlet and means for selectively vacuumizing said tank, said cleaner further having a suction line formed by a vacuum conduit connected to said inlet and by a wand connected to said conduit, said wand having a cleaning head including a vacuum nozzle connected through said suction line to said inlet, a conversion attachment for said vacuum cleaner and comprising:

(a) liquid discharge means, (b) means for mounting said liquid discharge means to said cleaning head, (c) a water line connected to said liquid discharge means and adapted for connection with said source of water, (d) an assembly inserted in said water line, said assembly including a source of detergent and also including liquid flow control means for dispensing detergent into said water line when water is flowing therethrough from the said source of water, (e) means for mounting said assembly to said suction line, (f) means disposed on said liquid flow control means for connecting the latter into said water line to thereby divide the latter into inlet and outlet line portions, (g) a detergent line connected between the interior of said detergent container and said liquid flow control means, (h) said liquid flow control means being constructed to selectively dispense pressurized water and detergent through said outlet line portion to said liquid discharge means of said cleaning head, and with said liquid flow control means comprising:

(1) a member forming a valve body having:

(A) a water inlet port connectable to said inlet line portion, (B) a detergent inlet port connected to said detergent line, (C) and a liquid outlet port connectable to said outlet line portion, (2) said ports being positioned so that said detergent inlet port is disposed between said water inlet port and said liquid outlet port, (3) a tubular valve member shorter than and slideably disposed in said valve body, said valve member having an inlet opening in its wall which is selectively registrable with said water inlet port, and having an inner head end having a discharge passageway disposed therein which faces said liquid outlet port, (4) said valve member being movable longitudinally in said valve body between:

(A) a retracted position wherein said inlet opening registers with said water inlet port and said head end terminates longitudinally outwardly of said liquid outlet port to form a metering chamber communicating with said detergent inlet port, said discharge passageway and said liquid outlet port, (B) and an extended position wherein the valve member wall blocks said water and detergent inlet ports and said metering chamber is replaced by the said head end of the valve member, (5) and means to move said valve member between said retracted and extended positions to thereby control the flow of liquid from said outlet port to said liquid discharge means of said cleaning head, (i) the construction being such that, upon actuation of said liquid flow control means of said assembly and said tank vacuumizing means of said cleaner, a mixture of water and detergent liquid is discharged through said liquid discharge means onto the surface to be cleaned and subsequently removed to the said recovery tank of said cleaner.

10. The conversion attachment of claim 9 wherein said assembly mounting means comprises means for removably connecting said assembly to said suction line.

11. A wet-dry vacuum cleaner device comprising:

(a) a recovery tank having an inlet and an outlet and mean for selectively vacuumizing said tank, (b) a suction line formable by a vacuum conduit connected to said inlet and by a removable lower cleaning unit connectable to said conduit, (c) said cleaning unit including a wand and vacuum nozzle connected through said suction line to said inlet, (d) liquid discharge means, (e) means for mounting said liquid discharge means to said cleaning unit adjacent said vacuum nozzle, (f) a water line connected to said liquid discharge means and adapted for connection with a source of pressurized water, (g) an assembly inserted in said water line, said assembly including a detergent container and also including liquid flow control means for dispensing detergent into said water line when water is flowing therethrough from the water source, (h) means for mounting said assembly to said suction line, (i) means disposed on said liquid flow control means for connecting the latter into said water line to thereby divide the latter into inlet and outlet line portions, (j) a detergent line connected between the interior of said detergent container and said liquid flow control means, (k) said liquid flow control means being constructed to selectively dispense pressurized water and detergent through said outlet line portion to said liquid discharge means, and said liquid flow control means comprising:

(1) a member forming a valve body having:

(A) a water inlet port connectable to said inlet line portion, (B) a detergent inlet port connected to said detergent line, (C) and a liquid outlet port connectable to said outlet line portion, (2) said ports being positioned so that said detergent inlet port is disposed between said water inlet port and said liquid outlet port, (3) a tubular valve member shorter than and slideably disposed in said valve body, said valve member having an inlet opening in its wall which is selectively registrable with said water inlet port, and having an inner head end having a discharge passageway disposed therein which faces said liquid outlet port, (4) said valve member being movable longitudinally in said valve body between:

(A) a retracted position wherein said inlet opening registers with said water inlet port and said head end terminates longitudinally outwardly of said liquid outlet port to form a metering chamber communicating with said detergent inlet port, said discharge passageway and said liquid outlet port, (B) and an extended position wherein the valve member wall blocks said water and detergent inlet ports and said metering chamber is replaced by the said head end of the valve member, (5) and means to move said valve member between said retracted and extended positions to thereby control the flow of liquid from said outlet port to said liquid discharge means, (l) the construction being such that, upon actuation of said liquid flow control means and said tank vacuumizing means, a mixture of water and detergent liquid is discharged through said liquid discharge means onto the surface to be cleaned and subsequently removed to the said recovery tank of said cleaner.

12. The device of claim 11 wherein said valve member moving means comprises:

(a) a cap disposed on the outer end of said valve body, (b) a control rod connected to said valve body and extending outwardly through said cap, (c) a manually actuatable handle pivotally mounted to the outer end portion of said control rod, (d) and a cam on said handle and engageable with said cap for causing said control rod and said valve member to shift longitudinally when said handle is actuated.

13. The device of claim 12 which includes means to bias said valve member longitudinally inwardly toward said liquid outlet port.

14. The device of claim 13 wherein said biasing means simultaneously biases said cam into engagement with said cap.

15. The device of claim 14 wherein:

(a) said control rod includes annular flange means disposed between the outer end of said valve member and said cap, (b) and said biasing means comprises a spring confined between said flange means and said cap.

16. The device of claim 11 or 15:

(a) wherein said assembly includes a tubular portion forming a vacuum air and liquid flow chamber, (b) and wherein said assembly mounting means comprises means disposed on each end of said tubular portion for securing the latter in said suction line for support of said assembly, (c) the construction being such that said subsequent liquid removal is through said tubular portion of said assembly.

17. For use with a source of water under pressure and a wet-dry vacuum cleaner having a recovery tank with an inlet and an outlet and means for selectively vacuumizing said tank, said cleaner further having a vacuum conduit connected to said inlet and a wand connected to said conduit, said wand having a cleaning head at its lower end with said head including a vacuum nozzle connected through said wand and conduit to said inlet; a conversion attachment for said vacuum cleaner and comprising:

(a) a substitute wand connectable to said vacuum conduit to form a suction line therewith and with said wand having a substitute cleaning head with a vacuum nozzle, (b) liquid discharge means mounted on said substitute cleaning head, (c) a water line connected to said liquid discharge means and adapted for connection with said source of water, (d) an assembly inserted in said water line, said assembly including a detergent container and also including liquid flow control means for dispensing detergent into said water line when water is flowing therethrough from the water source, (e) means for mounting said assembly to said suction line, (f) means disposed on said liquid flow control means for connecting the latter into said water line to thereby divide the latter into inlet and outlet line portions, (g) a detergent line connected between the interior of said detergent container and said liquid flow control means, (h) said liquid flow control means being constructed to selectively dispense pressurized water and detergent through said outlet line portion to said liquid discharge means of said substitute cleaning head, (i) the construction being such that, upon actuation of said liquid flow control means of said assembly and said tank vacuumizing means of said cleaner, a mixture of water and detergent liquid is discharged through said liquid discharge means onto the surface to be cleaned and subsequently removed to the said recovery tank of said cleaner, (j) said assembly including a tubular portion forming a vacuum air and liquid flow chamber, (k) and said assembly mounting means comprising cooperative latching means disposed between each end of said tubular portion and the respective vacuum conduit and substitute wand for joining said vacuum conduit and substitute wand together so that said subsequent liquid removal is through said tubular portion of said assembly.

18. A wet-dry vacuum cleaner device comprising:

(a) a recovery tank having an inlet and an outlet and means for selectively vacuumizing said tank, (b) a suction line formable by a vacuum conduit connected to said inlet and by a removable lower cleaning unit connectable to said conduit, (c) said cleaning unit including a wand and vacuum nozzle connected through said suction line to said inlet, (d) liquid discharge means, (e) means for mounting said liquid discharge means to said cleaning unit adjacent said vacuum nozzle, (f) a water line connected to said liquid discharge means and adapted for connection with a source of pressurized water, (g) an assembly inserted in said water line, said assembly including a detergent container and also including liquid flow control means for dispensing detergent into said water line when water is flowing therethrough from the water source, (h) means for mounting said assembly to said suction line, (i) means disposed on said liquid flow control means for connecting the latter into said water line to thereby divide the latter into inlet and outlet line portions, (j) a detergent line connected between the interior of said detergent container and said liquid flow control means, (k) said liquid flow control means being constructed to selectively dispense pressurized water and detergent through said outlet line portion to said liquid discharge means, (l) the construction being such that, upon actuation of said liquid flow control means and said tank vacuumizing means, a mixture of water and detergent liquid is discharged through said liquid discharge means onto the surface to be cleaned and subsequently removed to the said recovery tank of said cleaner, (m) said assembly including a tubular portion forming a vacuum air and liquid flow chamber, (n) and said assembly mounting means comprising cooperative latching means disposed between each end of said tubular portion and the respective vacuum conduit and wand for joining said vacuum conduit and wand together so subsequent substitute liquid removal is through said tubular portion of said assembly.

* * * * *

UNITED STATES PATENT AND TRADEMARK OFFICE

CERTIFICATE OF CORRECTION

PATENT NO. : 4,333,203

DATED : June 8, 1982

INVENTOR(S) : ROBERT A. YONKERS

It is certified that error appears in the above-identified patent and that said Letters Patent are hereby corrected as shown below:

| | |
|---|---|
| Column 9, Line 34 | Delete "mean" and substitute therefor ----means---- |
| Column 12, Line 51 | After "so" insert "that said" After "subsequent" delete "substitute" |

Signed and Sealed this

*Twenty-fourth* Day of *August 1982*

[SEAL]

*Attest:*

GERALD J. MOSSINGHOFF

*Attesting Officer*

*Commissioner of Patents and Trademarks*